US011530809B2

(12) United States Patent
Porciatti

(10) Patent No.: US 11,530,809 B2
(45) Date of Patent: Dec. 20, 2022

(54) PARTIALLY LIGHTED T-BAR

(71) Applicant: JLC-Tech IP, LLC, Weston, FL (US)

(72) Inventor: Silvio Porciatti, Pembroke, MA (US)

(73) Assignee: JLC-Tech IP, LLC, Weston, FL (US)

( * ) Notice: Subject to any disclaimer, the term of this patent is extended or adjusted under 35 U.S.C. 154(b) by 0 days.

(21) Appl. No.: 17/384,171

(22) Filed: Jul. 23, 2021

(65) Prior Publication Data

US 2021/0348752 A1 Nov. 11, 2021

Related U.S. Application Data

(63) Continuation of application No. 16/429,682, filed on Jun. 3, 2019, now Pat. No. 11,079,100, which is a continuation of application No. 14/948,803, filed on Nov. 23, 2015, now Pat. No. 10,309,638, which is a continuation-in-part of application No. 13/634,219, filed as application No. PCT/US2011/000455 on Mar. 10, 2011, now Pat. No. 9,879,850, which is a continuation of application No. 12/661,252, filed on Mar. 11, 2010, now Pat. No. 8,177,385.

(60) Provisional application No. 62/082,760, filed on Nov. 21, 2014.

(51) Int. Cl.

| | |
|---|---|
| ***F21V 29/76*** | (2015.01) |
| ***F21V 29/71*** | (2015.01) |
| ***F21V 33/00*** | (2006.01) |
| ***F21S 8/02*** | (2006.01) |
| *E04B 9/00* | (2006.01) |
| *E04B 9/06* | (2006.01) |
| *E04B 9/12* | (2006.01) |
| *E04B 9/28* | (2006.01) |

(52) U.S. Cl.

CPC ..... *F21V 29/76* (2015.01); *F21S 8/02* (2013.01); *F21V 29/713* (2015.01); *F21V 33/006* (2013.01); *E04B 9/006* (2013.01); *E04B 9/064* (2013.01); *E04B 9/122* (2013.01); *E04B 9/28* (2013.01)

(58) Field of Classification Search

CPC ..... F21S 8/04; F21S 8/026; F21S 8/043

See application file for complete search history.

(56) References Cited

U.S. PATENT DOCUMENTS

| | | | |
|---|---|---|---|
| 4,230,900 | A | 10/1980 | Speet |
| 4,794,745 | A | 1/1989 | Platt |
| 4,972,339 | A | 11/1990 | Gabrius |
| 5,313,759 | A | 5/1994 | Chase, III |

(Continued)

*Primary Examiner* — Andrew J Coughlin

(74) *Attorney, Agent, or Firm* — Heisler & Associates

(57) ABSTRACT

The partially lit T-bar includes a spine with a rest shelf at a lower portion thereof. The rest shelf supports adjacent ceiling tiles. The under surface of the rest shelf includes a lighting module on a portion and a plain unlit undersurface on other portions. Additional T-bars which are shorter, and typically fully lit or fully unlit and half the length of the partially lit T-bar are also provided which can attach at ends or near a midpoint of the partially lit T-bar and typically perpendicularly thereto. A great variety of lighting patterns in a dropped ceiling is thus facilitated. Each of the T-bars preferably also includes a heat sink on an upper portion of the spine and also preferably a lower heat sink on an upper portion of the rest shelf. Heat associated with the light element of the T-bar can thus be drawn away from a space below the ceiling.

17 Claims, 6 Drawing Sheets

(56) References Cited

U.S. PATENT DOCUMENTS

| | | | | |
|---|---|---|---|---|
| 5,454,756 | A | 10/1995 | Ludwig | |
| 5,613,759 | A | 3/1997 | Ludwig | |
| 5,687,527 | A | 11/1997 | Bikard | |
| 6,220,721 | B1 | 4/2001 | Chan | |
| 8,061,865 | B2 | 11/2011 | Piepgras | |
| 8,177,385 | B2 | 5/2012 | Porciatti | |
| 8,459,824 | B1 | 6/2013 | Esmailzadeh | |
| 2003/0021116 | A1 | 1/2003 | Miller | |
| 2003/0081419 | A1 | 5/2003 | Jacob | |
| 2004/0213003 | A1 | 10/2004 | Lauderdale | |
| 2005/0152132 | A1 | 7/2005 | Bernhart | |
| 2006/0262521 | A1 | 11/2006 | Piepgras | |
| 2008/0266843 | A1 | 10/2008 | Villard | |
| 2009/0147504 | A1 | 6/2009 | Teeters | |
| 2011/0058376 | A1 | 3/2011 | Lin | |
| 2011/0075416 | A1 | 3/2011 | Chou | |
| 2011/0080746 | A1 | 4/2011 | Patti | |
| 2011/0103043 | A1 | 5/2011 | Ago | |
| 2013/0323950 | A1 | 12/2013 | Gingrich, III | |
| 2015/0292719 | A1* | 10/2015 | Park | F21V 23/06<br>362/217.05 |

* cited by examiner

PARTIALLY LIGHTED T-BAR

CROSS-REFERENCE TO RELATED APPLICATIONS

This application is a continuation of U.S. patent application Ser. No. 16/429,682 filed on Jun. 3, 2019, which is a continuation of U.S. patent application Ser. No. 14/948,803 filed on Nov. 23, 2015, which claims benefit under Title 35, United States Code § 119(e) of U.S. Provisional Application No. 62/082,760 filed on Nov. 21, 2014 and is also a continuation-in-part of U.S. patent application Ser. No. 13/634,219 filed on Sep. 11, 2012 and issued as U.S. Pat. No. 9,879,850 on Jan. 30, 2018, which is a national stage entry of PCT International Application No. PCT/US11/00455 with an international filing date of Mar. 11, 2011, which is a continuation of U.S. patent application Ser. No. 12/661,252 filed on Mar. 11, 2010 and issued as U.S. Pat. No. 8,177,385 on May 15, 2012.

FIELD OF THE INVENTION

The following invention relates to T-bars for suspended ceilings, and particularly T-bars which include lighting therein. More particularly, this invention relates to T-bars and systems of T-bars where individual T-bar elements include a lit portion and an unlit portion, such as to achieve a large variety of lighting patterns in a suspended ceiling featuring lighted T-bars.

BACKGROUND OF THE INVENTION

Ceilings come in a variety of different configurations with one form of ceiling that is quite common, especially in office environments, being a dropped ceiling with ceiling tiles held in place by T-bars. The dropped ceiling is oriented in a plane parallel with the floor and suspended beneath a utility space within which HVAC, electrical, telephone and other utilities can be conveniently located.

The T-bars, in a simplest form, have a planar lower leg and a planar upper leg perpendicular to the lower leg and intersecting with the lower leg at a midpoint thereof. The lower surface of the lower leg faces downward. Portions of the lower leg on either side of the upper leg present shelves upon which ceiling tile edges can rest. The T-bars are arranged, typically in a grid pattern. This grid pattern can be made up of squares or rectangles (or other shapes). In a uniform grid ceiling, the ceiling tiles are in the form of squares with each edge of the ceiling tile supported upon an adjacent T-bar lower leg.

To form the grid of T-bars, typically T-bars running in a first direction are long T-bars, such as long enough to span an entire room (or as far as possible in a larger room where it is impractical to have T-bars spanning the entire length of the room). In a second direction perpendicular to the first direction, shorter T-bars are located which merely extend between adjacent long T-bars. In addition to supporting ceiling tiles, the T-bars can also support air conditioning returns and registers, as well as light fixtures and other equipment. The upper leg of each T-bar has holes periodically passing therethrough through which wire or other suspension elements can connect to support the suspended ceiling array of T-bars at the desired elevation above the floor.

One form of T-bar known in the prior art includes lighting built into the lower leg of the T-bar. One such LED lighted T-bar is described in U.S. Pat. No. 8,177,385, incorporated herein by reference. With such a lighted T-bar, the lower leg is provided with a greater depth and LED lights are located within the lower leg, and typically with some form of diffuser element over a surface of the LED and between the LED and a lower surface of the lower leg. Most preferably, especially with high intensity LEDs, the upper leg of the T-bar is configured to include heat transfer fins so that heat can be effectively dissipated away from the LEDs and outside of an air conditioned space below the suspended ceiling and into the utility space above the suspended ceiling. Lighting is thus provided in linear sections along the T-bars.

In a ceiling with long T-bars extending in a first direction and short T-bars extending perpendicularly between the long T-bars, LED lighted T-bars can conveniently span the short distance between long T-bars to present lighting into the space adjacent the suspended ceiling. However, such a configuration only facilitates lighting oriented in a first direction perpendicular to the long T-bars. In many instances for either functional and/or aesthetic reasons, it is desirable to have lighted T-bar segments both parallel to the long T-bars and perpendicular to the long T-bars. Also, lights of various lengths would be beneficial. Accordingly, a need exists for partially lighted T-bars and shorter fully lighted T-bars to provide a larger variety of options to achieve functional and aesthetic goals in lighting a space beneath a suspended ceiling.

SUMMARY OF THE INVENTION

With this invention a partially lighted T-bar is provided. In an exemplary embodiment shown herein, a partially lighted T-bar is provided which has a lower leg of the T-bar which has half of a length thereof fitted with an LED light and half of a length thereof left plain and without an LED light. As an example, if the overall length of the partially lighted T-bar is four feet (or about 1.2 meters in an equivalent SI unit system), one end could have a light built into the lower leg extending two feet (or about 0.6 meters) from this first end. The remainder of the partially lighted T-bar extending to a second end opposite the first end is left plain and without any light. Ends of the partially lighted T-bar have fasteners thereon which connect to slots in a long T-bar or some other adjacent T-bar.

In one exemplary embodiment, a grid ceiling is provided where long T-bars are spaced four feet apart. Two foot by two foot ceiling tiles, or a combination of two foot by two foot ceiling tiles and two foot by four foot ceiling tiles (or all two foot by four foot ceiling tiles) are oriented within the grid ceiling. To span the four foot distance between the long T-bars, four foot T-bars are provided. When an entire four foot length between the long T-bars is to be fitted with a light, a fully lighted four foot T-bar is utilized. Where only two feet of the four foot length between the two long T-bars is to be lighted, a partially lighted T-bar is provided between the long T-bars with the lighted portion positioned where desired. The grid ceiling could be considered complete at this point and two foot by four foot ceiling tiles would be utilized.

In at least some of the areas within the dropped ceiling, the ceiling grid can be configured to support two foot by two foot square ceiling tiles. In such locations, a two foot T-bar is provided extending parallel to the long T-bars and between adjacent four foot T-bars. Such a two foot T-bar would have fasteners at ends thereof which would interface with slots in the four foot T-bars. The two foot T-bar could be plain where no lighting is desired or could be lighted along its entire length where lighting is desired.

In the grid ceiling depicted in exemplary embodiments herein, two long T-bars are provided four feet apart. Three four foot T-bars are provided extending between the two long T-bars depicted. Two of the these four foot T-bars are plain T-bars with no lighting therein (however they could be lighted or partially lighted). A partially lighted T-bar is also provided between the long T-bar with a lighted portion at a left side of the grid ceiling depicted therein. Two two foot T-bars are provided parallel with the long T-bars and interposed between the four foot T-bars which are not lighted and the half lighted T-bar. One of these two foot T-bars is plain without light. The other two foot T-bar is entirely lighted. As a result, lighting is provided in a right angle.

As can be readily seen, with the provision of partially lighted T-bars, any two foot segment within a dropped ceiling featuring two foot by two foot square ceiling tiles or a combination of two foot by two foot ceiling tiles and two foot by four foot ceiling tiles can have lighting provided at any T-bar location where desired. Even where the long T-bars are located, either the long T-bars can be fitted with lights on a lower leg thereof or portions of the long T-bars where lights are desired can be cut away and replaced with four foot lighted T-bars or longer, or partially lighted T-bars. Because the T-bars are suspended by suspension elements, the long T-bars are not strictly required to be as long as possible to maintain structural support for the dropped ceiling, but rather are provided for convenience to minimize a total part count for the T-bars making up the dropped ceiling.

While in the exemplary embodiment depicted the partially lighted T-bar is a four foot T-bar which is being used in conjunction with other four foot T-bars which are fully lighted or non-lighted, and two foot T-bars which are either fully lighted or non-lighted, other configurations could be provided. The length of the partially lighted T-bar could be different in a grid ceiling where the ceiling tiles have different sizes. Also, the partially lighted T-bar could be provided with only one-fourth of the lower leg being lighted, which could be a fourth at an end or a fourth at a middle quarter adjacent the center of the partially lighted T-bar. The partially lighted T-bar could also be provided with lighting on a lower leg thereof with only one-third thereof either at an end or in the middle, or some other fraction of the overall length of the lighted T-bar and including either just one lighted section or multiple lighted sections.

It is not strictly necessary that the lighted portions of the partially lighted T-bar terminate at light corners with other lighted T-bars. For instance, a four foot T-bar could have two middle quarters of the four foot T-bar provided with lights and two end quarters of the lighted T-bar left plain. Two two foot T-bars could interface with the four foot T-bar at the middle slot thereof which two foot T-bars could be half lighted adjacent the partial lighted T-bar and half left plain. As a result, the lights would be provided in the form of small crosses measuring two feet in length in a first direction and two feet in length in a second direction. Large crosses could also be provided by utilizing a combination of fully lighted four foot long T-bars and fully lighted two foot long T-bars with the two foot long T-bars joining the four foot long T-bar at the middle slot in the four foot T-bar.

By providing partial lighted T-bars a maximum of lighting flexibility is provided. For instance, in a large room with a dropped ceiling and with multiple aisles between cubicles or other spaces, lighting can be provided to light the corridors between cubicles/spaces. Emergency lighting can be provided in the ceiling which could be a unique color, and could designate emergency pathways to follow when the building needs to be evacuated. For instance, T-bars adjacent a door which is not an exit could be illuminated red in an emergency. T-bars adjacent a door which is an appropriate exit can be lighted green. Lights in adjacent T-bars could also be caused to "chase" each other, by utilizing appropriate electronics coupled to power supplies of the T-bar lights, so that the lighting can appear to travel in a direction which should be followed when a person is evacuating a building. By providing partial lighted T-bars, such lighting can most effectively designate a corner where an evacuee needs to make a left or right hand turn to safely exit the building.

OBJECTS OF THE INVENTION

Accordingly, a primary object of the present invention is to provide a T-bar which supports a light source on a lower side thereof and which includes partially lighted undersides and shorter lighted T-bars to facilitate a wide variety of lighting arrangements.

Another object of the present invention is to provide a T-bar with included heat dissipation structures to dissipate heat from a heat source adjacent a lower surface of the T-bar.

Another object of the present invention is to provide a method for drawing heat away from a light source on a lower portion of a T-bar of a dropped ceiling system.

Another object of the present invention is to provide a dropped ceiling system with T-bars that include lighting therein in a wide variety of patterns.

Another object of the present invention is to minimize energy utilized by a lighted building space.

Another object of the present invention is to provide lighting for a building space with visually attractive lighting.

Another object of the present invention is to provide a lighting system for a building space which is easy and inexpensive to install and which exhibits a long life.

Another object of the present invention is to provide a lighting system for a building which can easily be replaced and reconfigured.

Another object of the present invention is to provide an LED light source for mounting within a dropped ceiling of a building and which effectively dissipates heat from the LED light source for optimal service life.

Other further objects of the present invention will become apparent from a careful reading of the included drawing figures, the claims and detailed description of the invention.

DESCRIPTION OF THE PREFERRED EMBODIMENT

Figures 1, 2, 3:
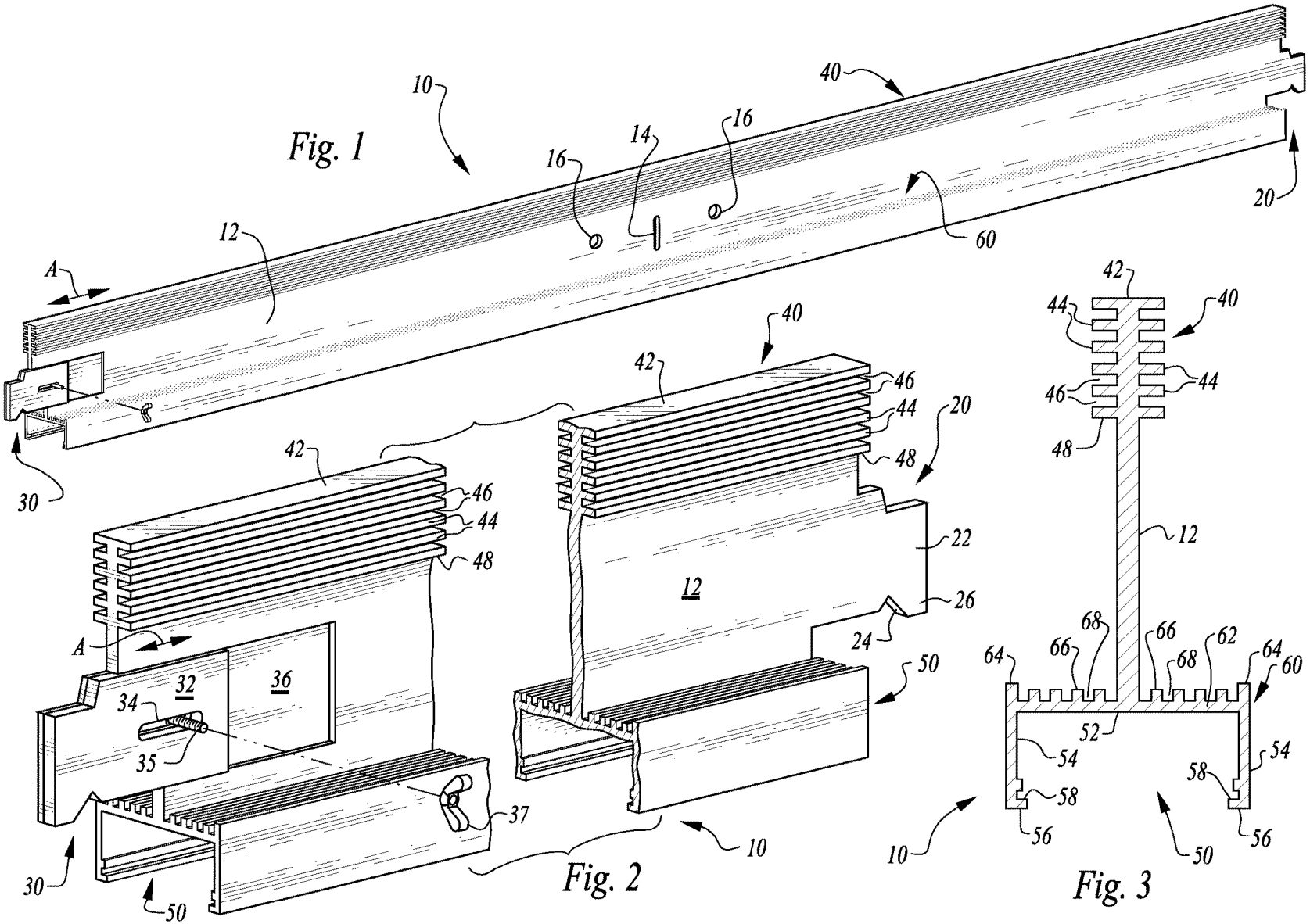
FIG. 1 is a perspective view of a T-bar according to a standard fully lit embodiment of this invention configured to include lighting mounted to a lower portion thereof and with heat dissipating structures above the light source.
FIG. 2 is a detail of that which is shown in FIG. 1 and with central portions of the T-bar cut away.
FIG. 3 is a full sectional view of the T-bar of FIGS. 1 and 2.

Referring to the drawings, wherein like reference numerals represent like parts throughout the various drawing figures, reference numeral 10 is directed to a basic fully lit T-bar (FIG. 1) forming a portion of a dropped ceiling system (FIG. 5) with the T-bar including a lighting module 70 (FIGS. 4, 5, 8 and 9) coupled to a lower end of the T-bar 10 for providing lighting in a space below the dropped ceiling system. The T-bar 10 includes heat dissipating structures including an upper heat sink 40 and lower heat sink 60 in this preferred embodiment for dissipating heat from the lighting module 70 or other heat sources adjacent the T-bar 10. A dropped ceiling system 100 (FIG. 15) can include partially lit T-bars 110 as well as fully lit T-bars 10 (FIG. 5) as well as long unlit (or lit) T-bars 410, short fully lit T-bars 210 (FIG. 14), short unlit T-bars 310 or non-lit T-bars 510, as examples, to facilitate a wide variety of suspended ceiling patterns.

In essence, and with particular reference to FIGS. 1-3, basic details of the T-bar 10 and associated features thereof are described according to one embodiment. The T-bar 10 is an elongate rigid structure extending between terminal ends and preferably having a substantially constant contour between the two terminal ends of the T-bar 10. A fixed anchor 20 is located at one of the terminal ends of the T-bar 10. An adjustable anchor 30 is provided at the opposite terminal end of the T-bar 10. The adjustable anchor 30 can be adjusted in length slightly (arrow A of FIGS. 1 and 2). The anchors allow the T-bar 10 to be connected to adjacent T-bars or other suspension structures, with the adjustable anchor 30 facilitating the process of attaching and detaching the T-bar 10 to adjacent structures, typically standard conventional prior art T-bars within a conventional dropped ceiling system.

The T-bar 10 includes an upper heat sink 40 on an upper portion of the T-bar 10. This upper heat sink 40 is adapted to efficiently transfer heat away from the T-bar 10 to air surrounding upper portions of the T-bar 10. A lower portion of the T-bar 10 preferably supports a light housing 50. This light housing 50 is configured to be located below a dropped ceiling of which the T-bar 10 is a part, with the light housing 50 adapted to hold a lighting module 70 therein, such as a light emitting diode (LED) lighting module 70. Preferably, a lower heat sink 60 is also provided on the T-bar 10. This lower heat sink 60 is preferably built into a rest shelf 62 of the T-bar 10 which also functions to hold edges of ceiling tiles C (FIGS. 4 and 5) adjacent the T-bar 10. A power supply 80 is provided (FIGS. 6 and 7) which can be attached to the T-bar 10, such as by removable attachment in a manner gripping the upper heat sink 40. The T-bar 10 thus supports the ceiling tiles C and also is configured to include lighting therein and adapted to transfer heat away from lighting or other structures adjacent lower portions of the T-bar 10 and to also support a power supply 80 for the lighting.

More specifically, and with continuing reference to FIGS. 1-3, particular details of the structure of the T-bar 10 itself are described, according to this one embodiment. The T-bar 10 is preferably a rigid elongate structure formed of aluminum. Most preferably, the T-bar 10 is extruded so that it has a constant cross-sectional form (FIG. 3) including the various features provided by this and other embodiments of this invention.

The T-bar 10 could be formed of other materials, with emphasis placed on the ability of the material to facilitate conduction heat transfer therethrough, and also have desirable weight and strength characteristics to operate as a portion of a dropped ceiling system. Other materials which might be suitable in some circumstances include steel. It is also conceivable that the T-bar 10 could be formed of separate components attached together, with the separate components either being made of a common material or from different materials. If the different portions of the T-bar 10 are formed of different materials and different subassemblies, these subassemblies are preferably fixedly held adjacent each other such that the T-bar 10 functions primarily as a single unit.

Figure 5:
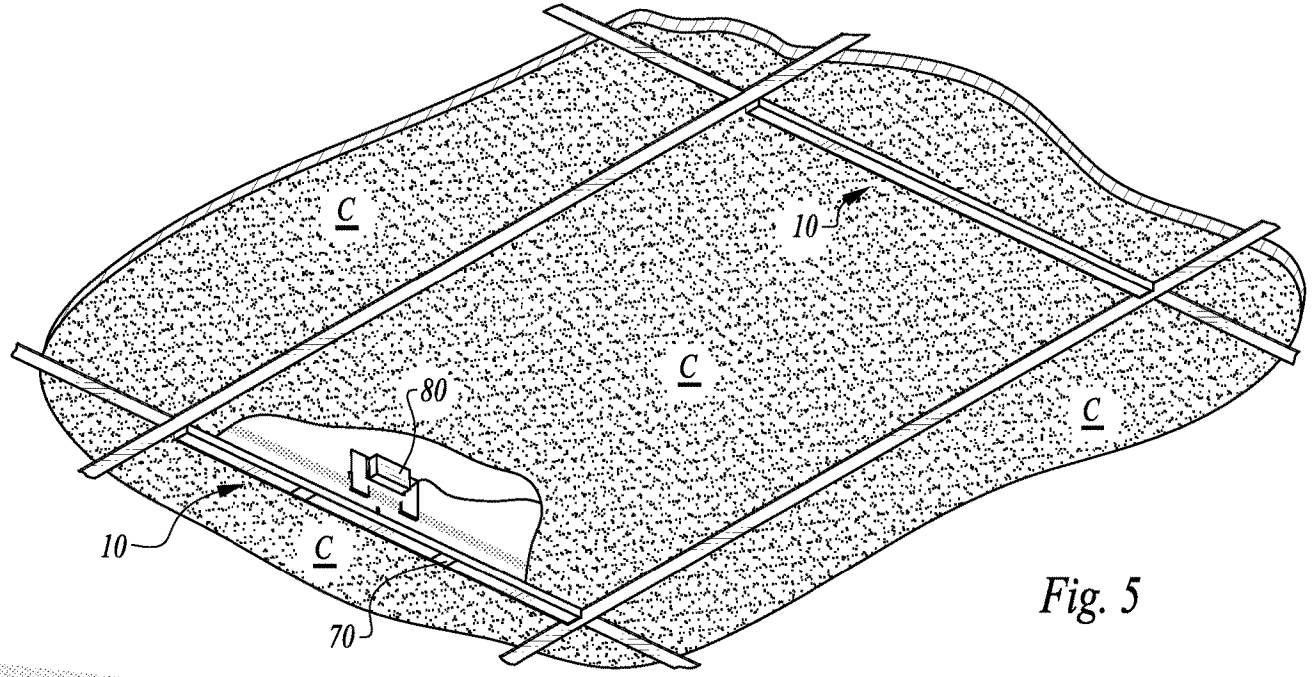
FIG. 5 is a perspective view of a dropped ceiling system including the T-bar of FIG. 1 and with a portion of a ceiling tile cut away to reveal portions of the T-bar above the dropped ceiling, as well as a power supply coupled to the T-bar and for supplying electric power to the lighting according to this invention.

The cross-section of the T-bar 10 generally includes a spine 12 which is preferably a somewhat thin planar structure which extends substantially vertically up from a rest shelf 62. The spine 12 and rest shelf 62 together form an inverted "T" to generally form the T-bar 10. The spine 12 preferably includes a slot 14 near a midpoint thereof, and potentially at other portions passing through the spine 12. The slot 14 is configured to receive tabs 22 of adjacent T-bars 10 that might be suspended from the slot 14 in the T-bar 10 to complete the dropped ceiling. Suspension holes 16 also preferably pass through the spines 12. These suspension holes 16 can accommodate wires or other suspension lines which extend up to anchor points above the dropped ceiling so that the suspension holes 16 act to support the entire dropped ceiling in a desired position (FIG. 5). Additional suspension holes 16 can be provided if required.

The T-bar 10 in this embodiment is approximately two feet long. In other embodiments, the T-bar 10 could be longer (or shorter) but preferably has a contour similar to that disclosed in FIGS. 1-3 regardless of the length of the T-bar 10. Another standard size for the T-bar 10 would typically be four feet. Conceivably in particularly long lengths, the T-bar 10 might be slightly changed in geometry to have the structural strength required to remain rigid over such long spans. Other modifications to the T-bar 10 can be made consistent with known techniques for T-bar modification within the dropped ceiling T-bar art.

With particular reference to FIG. 2, details of the fixed anchor 20 and adjustable anchor 30 for the terminal ends of the T-bar 10 are described, according to one embodiment. While the T-bar 10 could conceivably include two fixed anchors 20 or two adjustable anchors 30, preferably the T-bar 10 includes one fixed anchor 20 and one adjustable anchor 30. The fixed anchor 20 includes a tab 22 defining a thin axial extension from the spine 12 sized to fit within the slot 14 of another T-bar. A lower portion of this tab 22 is preferably configured with a lower notch 24. A tooth 26 preferably is provided beyond the lower notch 24 and defines a portion of the tab 22 lower than other portions of the tab 22. Taken together, the tab 22 with the lower notch 24 and tooth 26 allow the fixed anchor 20 to pass through a slot 14 or other related support structure with the tooth 26 hanging down beyond the slot 14 and with the lower notch 24 straddling the slot 14, so that the tab 22 is generally held within the slot 14. To remove the fixed anchor 20 from within the slot 14, a user would lift slightly on the T-bar 10 and then translate the tab 22 of the fixed anchor 20 out of the slot 14 by translating the entire T-bar 10.

When the end of the T-bar 10 opposite the fixed anchor 20 is positioned so that it cannot be readily moved, it is desirable to utilize an adjustable anchor 30 on at least one end of the T-bar 10. With the adjustable anchor 30, the tab 22 can be removed from one of the terminal ends of the T-bar 10 even when each end of the T-bar 10 is positioned where it cannot be translated linearly axial to an elongate axis of the T-bar 10 due to constraints adjacent ends of the T-bar 10.

In particular, and in this exemplary embodiment, the adjustable anchor 30 preferably has a form similar to the fixed anchor 20, except that the tab 22 is capable of translating horizontally and axially along a long axis of the T-bar 10 (along arrow A of FIGS. 1 and 2). The adjustable anchor 30 is preferably mounted on a plate 32. This plate 32 includes a slot 34 therein and resides within a recess 36 at an end of the spine 12, adjacent the terminal end having the adjustable anchor 30 thereon. The recess 36 defines a portion of the spine 12 of only partial thickness within which the plate 32 resides. A threaded shaft 35 passes through the slot 34 and is fixed to the spine 12. This slot 34 can slide relative to the threaded shaft 35 so that the adjustable anchor 30 is allowed to translate linearly in a horizontal direction, but is restrained from other motion.

A wing nut 37 or other fastener is preferably provided which can attach to the threaded shaft 35 and affix the adjustable anchor 30 in any given position relative to the slot 34. Thus, for instance, when the T-bar 10 is to be removed from an adjacent T-bar, the wing nut 37 of the adjustable anchor 30 is loosened. Next, the adjustable anchor 30 is allowed to translate with the slot 34 sliding over the threaded shaft 35 until the tab 22 associated with the adjustable anchor 30 has been moved out of the slot 14 in which it is anchored. The entire T-bar 10 can then be translated in a downward direction. The T-bar 10 can then be replaced with a replacement T-bar of any variety. The adjustable anchor 30 can be modified to connect within other existing ceiling systems. In such other ceiling systems the fixed anchor 20 could also be modified to attach within such systems.

Figure 4:
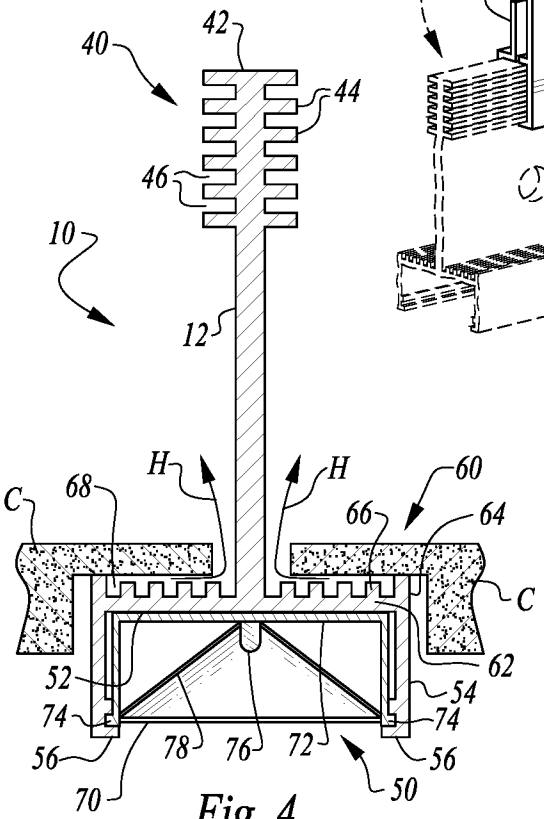
FIG. 4 is a full sectional view similar to that which is shown in FIG. 3 but with included ceiling panels resting upon the T-bar and a lighting module located within a light housing of the T-bar.

With particular reference to FIGS. 2-4, particular details of the upper heat sink 40 of the T-bar 10 are described, according to one embodiment. The T-bar 10 is preferably configured with the upper heat sink 40 formed and positioned to efficiently transfer heat from the T-bar 10 to air space adjacent upper portions of the T-bar 10. To facilitate such heat transfer, the upper heat sink 40 is provided. By enhancing a surface area of the T-bar 10 adjacent the upper heat sink 40, natural convection is accelerated so that heat is drawn away from the T-bar 10 more rapidly.

Conduction heat transfer between a lighting module 70 adjacent a lower end of the T-bar 10 can thus more effectively occur through the T-bar 10, to the upper heat sink 40. Convection heat transfer then effectively moves the heat from the heat sink 40 out to air surrounding the upper heat sink 40, to minimize temperature increase of the lighting module 70 and enhance its operating longevity. Also, with LED lighting, such temperature reduction causes the lighting module 70 to most efficiently convert electric power to light, enhancing the efficiency with which the lighting module 70 operates.

The upper heat sink 40 includes at least one fin, but most preferably includes a series of fins extending laterally from each side of an upper end of the spine 12. In the embodiment shown, six fins 44 extend laterally from each side of the spine 12, between an upper end 42 and a lower end 48. Lateral gaps 46 are provided between the adjacent lateral fins 44. Air within the lateral gaps 46 is heated and then passes out of the lateral gaps 46 by natural convection, being replaced by cooler air which is then heated and travels out by natural convection, with this process continuing so that natural convection heat transfer accelerates removal of heat from the T-bar 10 through the upper heat sink 40.

The upper heat sink 40 also acts as a portion of the T-bar 10 which conveniently facilitates attachment of the power supply 80 associated with the lighting module 70 to be mounted to the T-bar 10 in a convenient and reliable manner, as described in detail below.

With continuing reference to FIGS. 2-4, details of the light housing 50 of this invention are described according to one embodiment. The light housing 50 defines a portion of the T-bar 10 which is particularly configured to contain a lighting module 70 therein, such as a light emitting diode (LED) lighting module 70. The light housing 50 could have a variety of different configurations with the configurations shown here merely being one such effective configuration.

The light housing 50 is preferably rigid in form and shaped along with the other portions of the T-bar 10 as a single unitary mass of material. This light housing 50 includes a top wall 52 which is preferably planar and extends substantially horizontally and acts as an underside of the rest shelf 62 upon which ceiling tiles C are positioned. Side walls 54 extend down from front and back edges of the top wall 52. These side walls 54 are preferably parallel with each other and substantially mirror images of each other. Tips 56 of the side walls 54 define lowermost portions of this light housing 50, with a light supporting space therebetween.

Track slots 58 are preferably provided in the side walls 54 adjacent the tips 56. These track slots 58 can help to hold and direct into the light housing 50 a lighting module 70, such as that described and shown in FIG. 4, including a light element 76 that is preferably in the form of a light emitting diode (LED).

Figure 8:
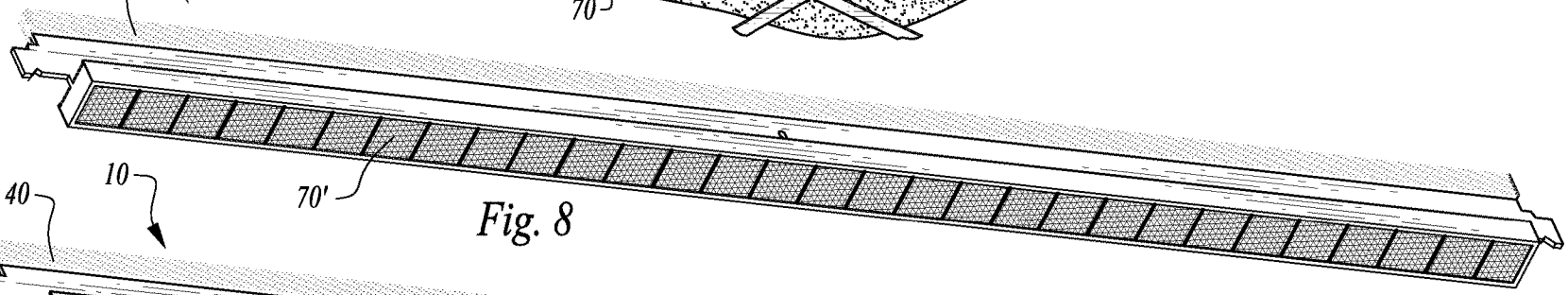
FIG. 8 is a perspective view of a T-bar with included lighting module according to an alternative embodiment featuring low intensity light emitting diode (LED) lighting technology.
Figure 9:
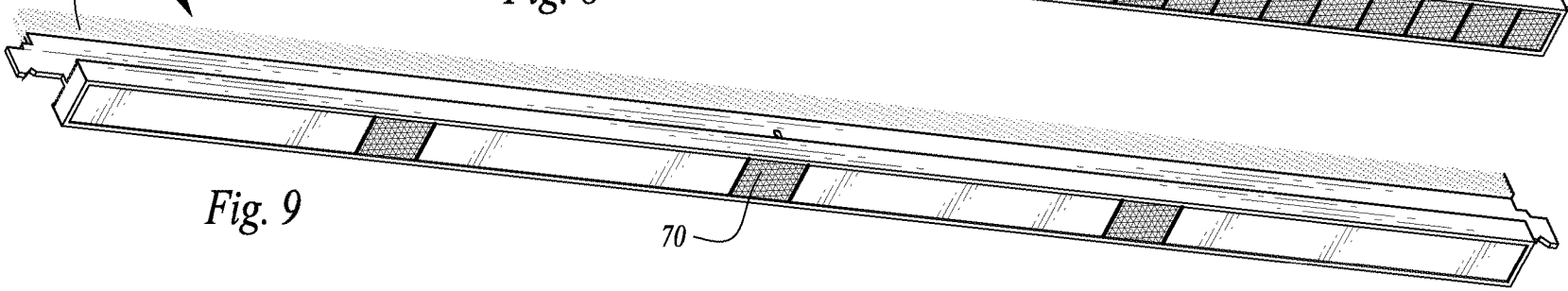
FIG. 9 is a perspective view of the T-bar of one form of this invention with included lighting module in the form of three high intensity light emitting diodes (LEDs), for example.

The lighting module 70 can be any of a variety of different kinds of lighting modules, but is most preferably an LED lighting module such as the low intensity lighting module 70' associated with the T-bar 10' (FIG. 8) or the high intensity lighting module 70 associated with the T-bar 10 shown in FIG. 9. In the embodiment of FIG. 8, thirty separate LEDs make up the low intensity lighting module 70. In the embodiment of FIG. 9, three high intensity LEDs provide the lighting module 70 and would typically provide a similar amount of light (if not more) than that supplied by the low intensity lighting module of FIG. 8. High intensity LEDs require an even greater amount of heat dissipation than low intensity LEDs for optimal life.

With further reference to FIG. 4, the particular details of the lighting module 70 preferably include an enclosure 72 which fits within the light housing 50 and includes side rails 74 which rest within the track slots 58 of the light housing 50 to support the lighting module 70 within the light housing 50. A light element 76 is included within the lighting module 70 as well as required electronics. A reflector 78 is preferably provided to optimally reflect most of the light down to the space below the lighting module 70.

Preferably, portions of the lighting module 70 including the enclosure 72 are formed of aluminum or other relatively high rate of heat transfer materials to optimize heat transfer from the light element 76 and associated electronics to the adjacent light housing 50 and other portions of the T-bar 10. The top wall 52 of the light housing 50 is configured to be directly adjacent upper portions of the enclosure 72 of the lighting module 70. In this way, conduction heat transfer can efficiently occur between the lighting module 70 and the light housing 50 of the T-bar 10.

Most preferably, the T-bar 10 includes a lower heat sink 60 in addition to the upper heat sink 40, but could optionally have only the upper heat sink 40 or only the lower heat sink 60. Additionally, further heat sinks could be attached to or formed with the T-bar 10, such as extending laterally from the spine 12 below the upper heat sink 40. The lower heat sink 60 includes a plurality of fins extending up from the rest shelf 62. These fins preferably include an outer fin 64 most distant from the spine 12 and short fins 66 between the outer fins 64 and the spine 12. Vertical gaps 68 are provided between the fins 64, 66.

While these fins 64, 66 generally act to enhance convection heat transfer, these fins 64, 66 also are preferably configured so that air between the fins 64, 66, and within the gaps 68 is not trapped, but rather can travel out (along arrow H of FIG. 4) of these gaps. By providing the outer fins 64 as tall fins, taller than the short fins 66, such a gap is provided for passage of air (along arrow H of FIG. 4) with the ceiling tile C resting upon the outer fin 64 and above the short fins 66. If required, portions of the ceiling tile C adjacent the rest shelf 62 could be adjusted geometrically and/or formed of alternate materials to ensure that this gap for heat transfer along arrow H is maintained.

Figure 7:
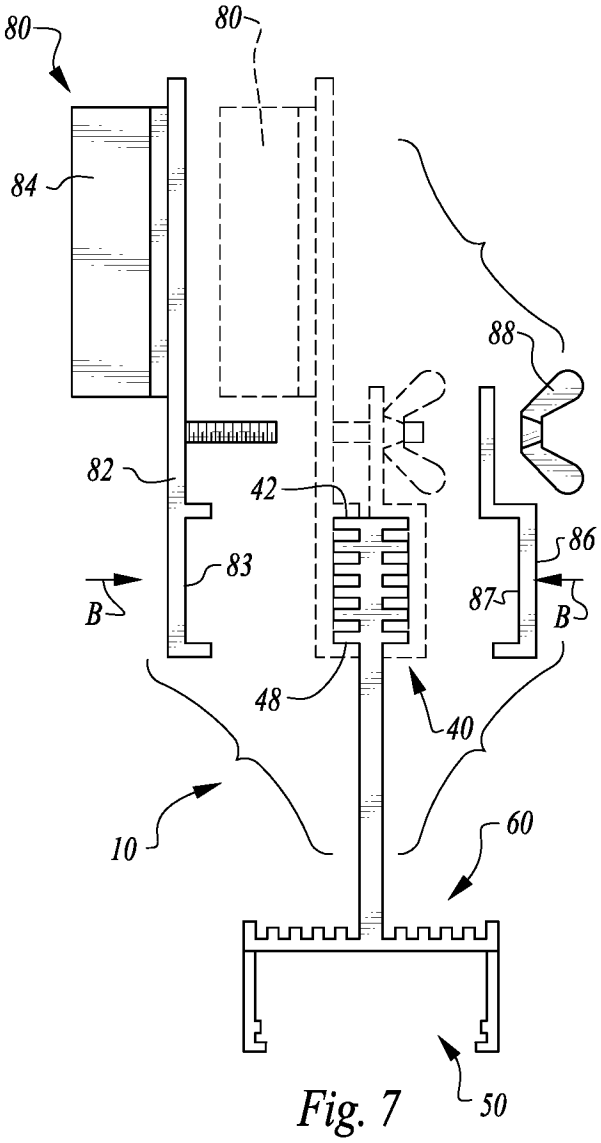
FIG. 7 is a sectional view of that which is shown in FIG. 6 and with the power supply exploded away from the T-bar and shown in phantom coupled to the T-bar to illustrate how the power supply is removably attachable to the T-bar.
Figure 6:
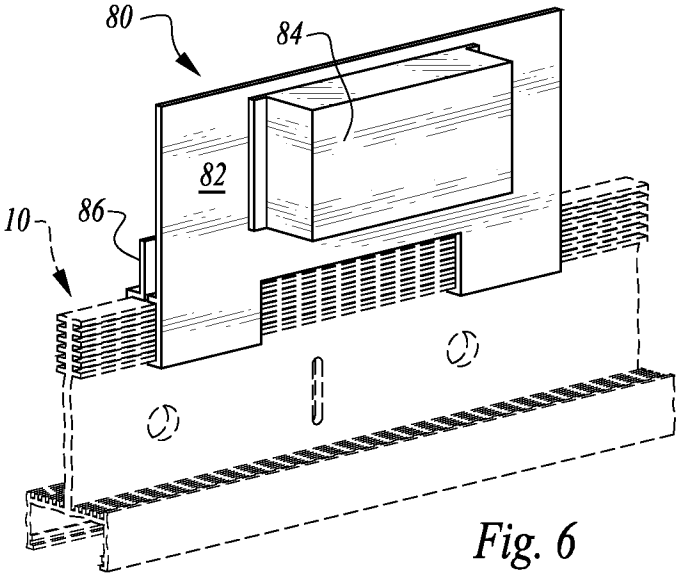
FIG. 6 is a perspective view of the power supply for supplying power to the light module of this invention, shown attached to the T-bar of FIG. 1, with the T-bar shown in broken lines.

With particular reference to FIGS. 5-7, details of the power supply 80 for conditioning and delivering power to the lighting module 70 and mounting the power supply 80 to the T-bar 10 are described, according to one embodiment. The light element 76 within the lighting module 70 typically requires electric power having a particular voltage, current and potentially cycle rate (for AC power) and perhaps other characteristics for optimal performance. The power supply 80 is preferably provided to transform available power into power having a form most optimal for powering the light source 76 within the lighting module 70. In the case of LED lighting, typically low voltage DC power is required. Often available power for the lighting is in the form of between 110 volt and 277 volt AC power. The power supply 80 in such a configuration would be primarily in the form of an AC to DC transformer with an output voltage matching that required for the LED lighting involved.

The power supply 80 is preferably generally provided as a module 84 in an enclosure that is mounted upon a plate 82 which is preferably substantially planar and configured to be aligned substantially coplanar with the spine 12. In this way, the power supply 80 and associated mounting hardware generally remain in an area directly above the T-bar 10 so that ceiling tiles C resting upon the T-bar 10 can still be readily moved off of the T-bar 10 to replace ceiling tiles C and to access space above the dropped ceiling.

A separate bracket 86 is preferably provided which is removably and adjustably attachable, such as through a fastener 88 to the plate 82. In one embodiment, this fastener 88 is in the form of a wing nut acting on a threaded shaft mounted to the plate 82. A channel 83 is preferably formed of a plate 82 and a channel 87 is preferably formed on the bracket 86. These channels 83, 87 are preferably complemental in form and facing each other. These channels 83, 87 preferably have a height similar of a height between the upper end 42 and lower end 48 of the upper heat sink 40. Thus, when the fastener 88 tightens the bracket 86 toward the plate 82, the channels 83, 87 can grip the upper heat sink 40 and hold the entire plate 82 and associated module 84 of the power supply 80 rigidly to the T-bar 10.

Wiring (FIG. 5) extends from a source of power down to the module 84 of the power supply 80. Additional wiring (not shown) would be routed from the module 84 down to the lighting module 70, such as through holes in the top wall 52 of the light housing 50, to provide power to the lighting module 70. It is conceivable that a single power supply 80 could be provided for each lighting module 70 of each T-bar 10, or a single power supply 80 could serve more than one lighting module 70 of multiple separate T-bars 10.

While the T-bar 10 of this preferred embodiment has been described in an embodiment where a lighting module is held within a light housing 50 of the T-bar 10, the T-bar 10 could support other structures which require heat dissipation, other than lighting, or lighting other than LED lighting. For instance, a fluorescent light bulb could be supported within the light housing 50 according to this invention. Other heat generating accessories desired to be mounted within the ceiling could also be mounted to the T-bar 10, for instance loud speakers could be fitted to lower portions of the T-bar 10 with heat dissipation provided by the various heat sinks 40, 60 of the T-bar 10 according to various different embodiments of this invention.

Figure 10:
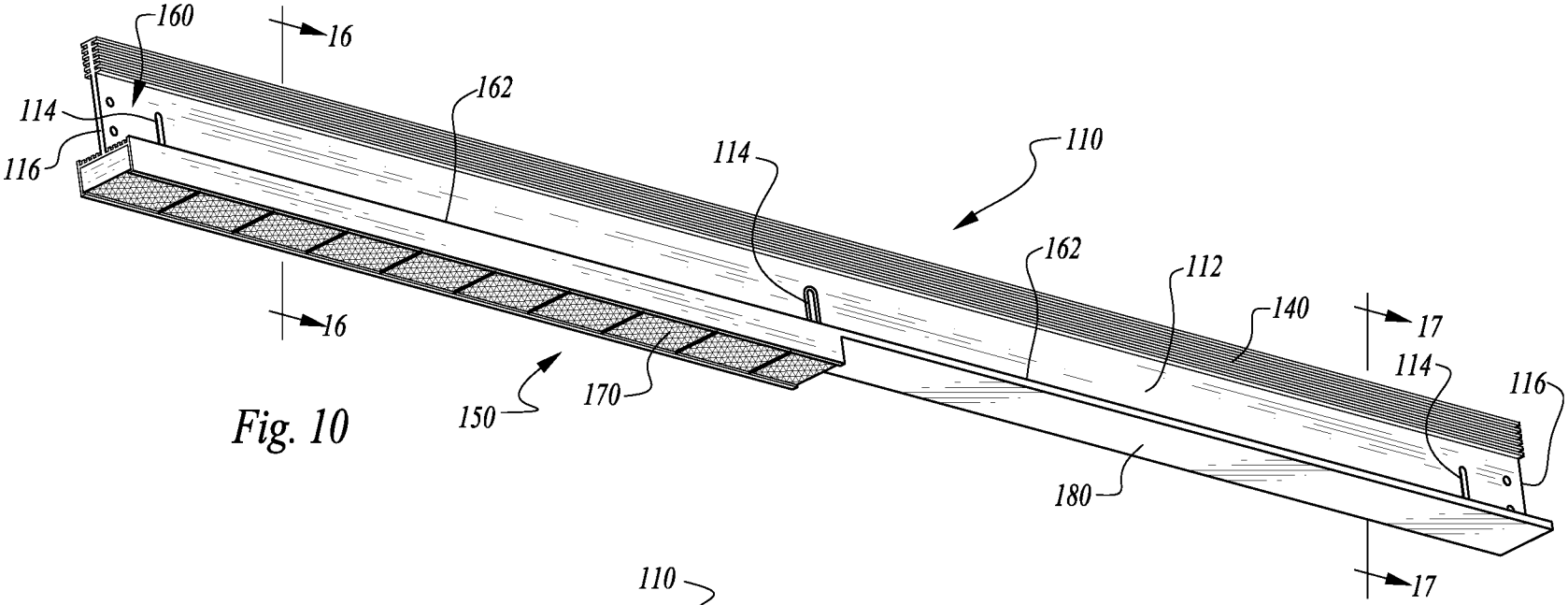
FIG. 10 is a perspective view of a partially lit T-bar according to this invention.
Figure 11:
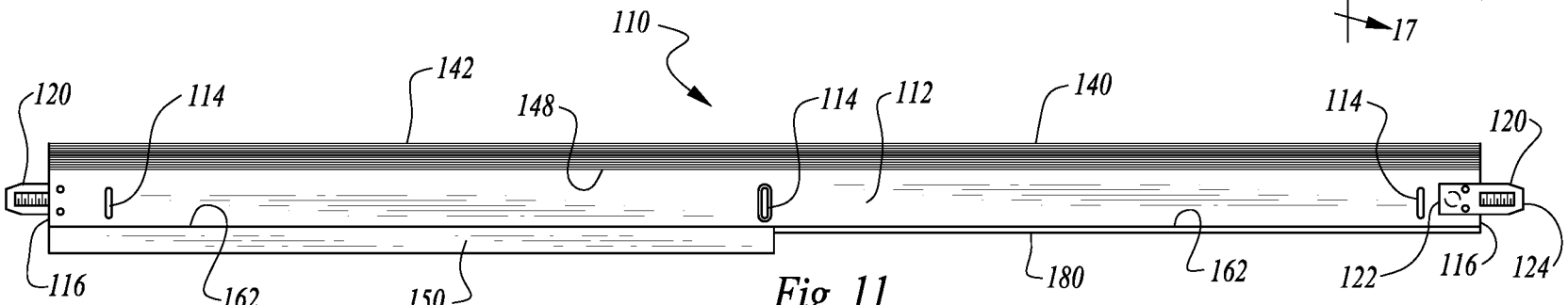
FIG. 11 is a front elevation view of that which is shown in FIG. 10.
Figure 12:
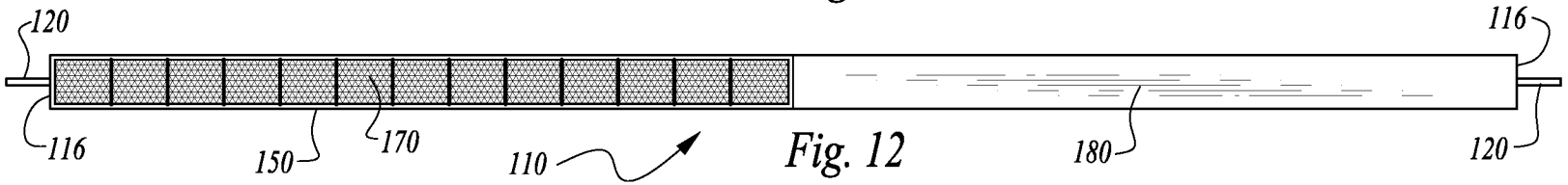
FIG. 12 is a bottom plan view of that which is shown in FIG. 10.
Figures 13, 14, 15:
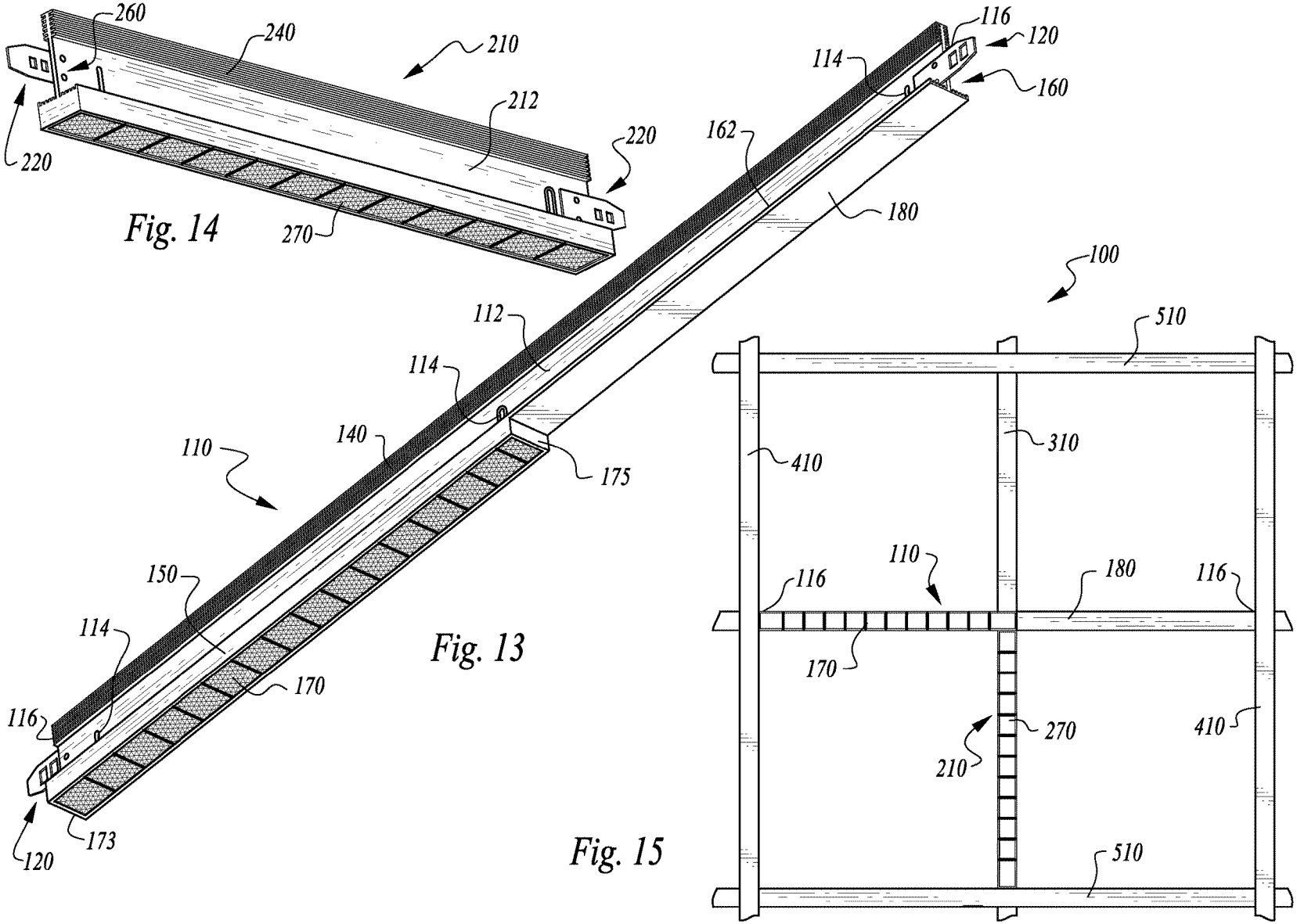
FIGS. 13 and 14 are perspective views of a T-bar lighting system including a long partially lit T-bar and a short T-bar which is fully lit, and with the two T-bars generally oriented close to where they could connect together with one end of the short T-bar connecting to a midpoint of the partially lit longer T-bar.
FIG. 15 is a bottom plan view of a portion of a suspended ceiling incorporating the partially lit T-bar and short T-bar of FIGS. 13 and 14 therein.
Figure 16:
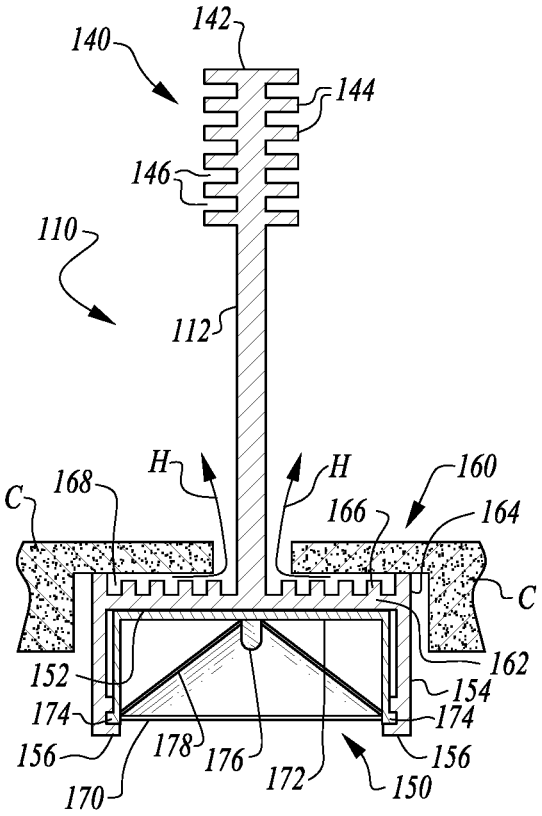
FIG. 16 is a full sectional view of a portion of that which is shown in FIG. 10, taken along lines 16-16 of FIG. 10.
Figure 17:
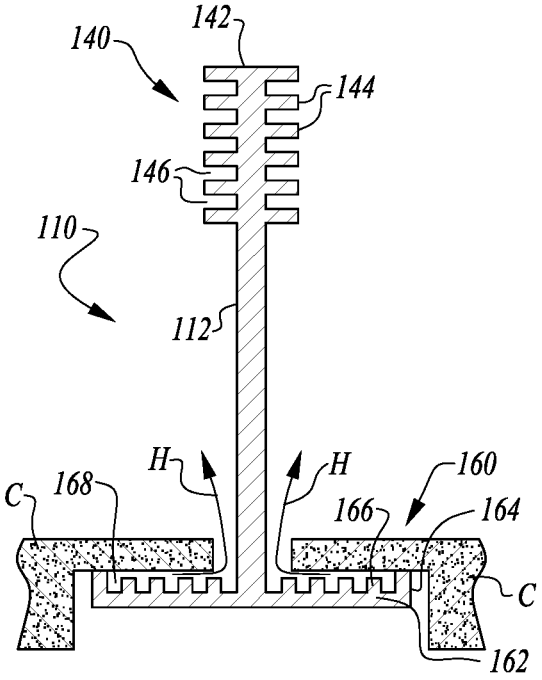
FIG. 17 is a full sectional view of a portion of that which is shown in FIG. 10, taken along lines 17-17 of FIG. 10.

With particular reference to FIGS. 10-12, details of an alternative partially lit T-bar 110 are described, according to an alternative embodiment. The partially lit T-bar 110 has details similar to those described above with respect to the T-bar 10 (FIG. 1) except where specifically identified herein. Thus, the partially lit T-bar 110 has a spine 112 which includes a heat sink 140 at an upper end 142 thereof and a light housing 150 at a lower end 148 of the spine 112. A lower heat sink 160 is provided on a rest shelf 162 defining an upper portion of the light housing 150. A lighting module 170 is contained within the light housing 150. With the T-bar 110, couplings 120 are disclosed for joining ends of the T-bars 110 or adjacent T-bars or other structures together. These couplings 120 generally include an attached end 122 and an extending end 124. The attached end 122 is affixed, either slidably or non-slidably to the spine 112 adjacent an end 116 thereof. The extending end 124 is located opposite the attached end 122 and extends past the ends 116 of the spine 112. These extending ends 124 are sized to fit within slots 114 of adjacent partially lit T-bars 110, or T-bars 10 or short T-bars 210 (FIG. 14) or other structures within an overall dropped ceiling system 100 (FIG. 15).

The heat sink 140 includes fins 144 with gaps 146 therebetween with a configuration similar to that of the heat sink 40 (FIGS. 1-3). The light housing 150 includes a top wall 152 inboard of an underside of the rest shelf 162 with side walls 154 extending downwardly from edges thereof to tips 156. The lighting module 170 fits inboard of this light housing 150 and includes an enclosure 172 with a light element 176 therein. Side rails 174 extend down defining portions of the enclosure 172. A reflector 178 is located within the enclosure 172.

The lighting module 170 is similar to the lighting module 70 of the T-bar 10 (FIG. 4) except that extreme ends of the lighting module 170 are defined by an end wall 173 at one end of the partially lit T-bar 110 and a mid-wall 175 at an end of the lighting module 170 at a mid-point of the T-bar 110. A remainder of an underside of the rest shelf 162 is provided as a light-free plain surface 180.

The short T-bar 210 includes a spine 212 and has a configuration generally similar to that of the T-bar 10 (FIG. 1) except that it is shorter and has been fitted with the couplings 220 which are similar to the couplings 120 of the T-bar 110 (FIGS. 10-12). The short T-bar 210 thus includes a heat sink 240 as well as a lower heat sink 260 and a lighting module 270 similar to those of the T-bar 10.

Within the dropped ceiling system 100 (FIG. 15) further elements can include short T-bars 310 which are not lighted and extra long T-bars 410. Also, non-lighted T-bars 510 of the same length as the partially lit T-bars 110 can be provided. In one embodiment, the partially lit T-bar 110 is four feet long and the short T-bar 210 is two feet long. The non-lit T-bar 510 is four feet long and the non-lit short T-bar 310 is two feet long. The extra long non-lit T-bar 410 can be provided in standard lengths, e.g. twenty feet, and then cut to size to fit within a room.

Typically, extra long unlit T-bars 410 would initially be installed with four feet spaced between them. If a user desires to have full light on a T-bar spanning this four foot length, a fully lit T-bar 10 would be utilized perpendicular to the extra long T-bars 410. If it is desired that the space be only partially lit, then the partially lit T-bar 110 can be utilized. To complete a two by two foot grid as depicted in FIG. 15, after a four foot long T-bar, such as the partially lit T-bar 110, is installed spanning the extra long T-bars 410, along with either non-lit T-bars 510 or additional partially lit T-bars 110, or fully lit T-bars 10, short T-bars such as the fully lit short T-bar 210 or non-lighted short T-bars 310 can be oriented parallel to the extra long T-bars 410 and connected to the partially lit T-bars 110, non-lit T-bars 510 or fully lit T-bars 10 which span between the extra long T-bars 410. A resulting finished dropped ceiling system 110 is thus provided where ceiling tiles of a two foot by two foot size can be placed between T-bars and portions of the T-bars themselves can be selected to be lit or unlit according to a pattern desired, and without constraints, other than the constraint that the extra long T-bars 410 provided every four feet are unlit.

In other dropped ceiling systems 110, the extra long non-lit T-bars 410 can be dispensed with by having additional suspension points when installing the suspended ceiling 100. Alternatively, extra long T-bars could be provided which include lighting modules built thereinto. In the hands of a skilled designer, this variety of fully lighted and partially lighted T-bars 10, 110, 210 having different lengths allow for a great expansion in creativity in the design of ceiling lighting systems which all benefit from being conveniently located within the T-bars themselves and which efficiently keep heat away from the air conditioned space in accordance with this invention.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A method for providing light beneath a suspended ceiling, including the steps of:

attaching opposing terminal ends of a partially lighted T-bar to other T-bars within the suspended ceiling, the partially lighted T-bar having a single elongated spine extending between the opposing terminal ends, a rest shelf at a lower portion of the spine, the rest shelf separated into two sides by the single elongated spine, a light covering a portion of an underside of the rest shelf, and an unlit surface on a portion of said underside of said rest shelf;

placing at least one ceiling tile upon each of the two sides of the rest shelf; and wherein said attaching step includes the partially lighted T-bar having a slot within the spine at a location adjacent to a transition between the portion of the underside of the rest shelf with the light and the portion of the underside of the rest shelf with the unlit surface.

2. The method of claim 1 wherein said attaching step includes the light located within a compartment extending from a lower portion of the rest shelf.

3. The method of claim 2 wherein the compartment includes a pair of sidewalls extending down from a lower portion of the rest shelf.

4. The method of claim 3 wherein the pair of sidewalls are parallel and spaced from each other by a width of the compartment.

5. The method of claim 2 wherein the compartment has a substantially constant cross-sectional form between the pair of sidewalls.

6. The method of claim 1 wherein said providing step includes approximately half of the underside of the rest shelf being covered by the light.

7. The method of claim 1 including the further step of connecting an end of an unlit T-bar to the slot in the spine.

8. The method of claim 1 including the further step of connecting an end of a partially lighted T-bar to the slot in the spine.

9. The method of claim 1 including the further step of connecting a fully lighted T-bar to the slot in the spine.

10. The method of claim 9 including the further step of supplying power to the partially lighted T-bar and to the fully lighted T-bar to cause light to emanate from the partially lighted T-bar and the fully lighted T-bar with the visual appearance of a corner of light.

11. A method for shining light down from a suspended ceiling, including the steps of:

placing a partially lighted T-bar within a grid of T-bars of the suspended ceiling, the partially lighted T-bar including at least one elongated spine extending between opposing terminal ends, a rest shelf at a lower portion of the spine, the rest shelf separated into two lateral sides by the at least one elongated spine and configured so that at least one ceiling tile may rest upon each of the two sides of the rest shelf, a light covering a portion of an underside of the rest shelf, and an unlit surface on a portion of the underside of the rest shelf;

resting edges of ceiling tiles upon each of the two lateral sides of the rest shelf;

wherein said placing step includes the partially lighted T-bar having a slot within the spine; and wherein said placing step includes the slot within the spine located adjacent to a transition between the portion of the underside of the rest shelf with the light and the portion of the underside of the rest shelf with the unlit surface.

12. The method of claim 11 wherein said placing step includes the light located within a compartment extending from the lower portion of the rest shelf.

13. The method of claim 12 wherein the compartment includes a pair of sidewalls extending down from a lower portion of the rest shelf.

14. The method of claim 13 wherein the pair of sidewalls are parallel and spaced from each other by a width of the compartment.

15. The method of claim 14 wherein the compartment has a substantially constant cross-sectional form between the pair of sidewalls.

16. The method of claim 11 wherein said placing step includes the portion of the underside of the rest shelf that is unlit being about half of a length of the underside of the rest shelf.

17. The method of claim 11 including the further step of connecting an end of another T-bar to the slot in the spine.

* * * * *